US006743558B2

(12) United States Patent
Yamaguchi et al.

(10) Patent No.: US 6,743,558 B2
(45) **Date of Patent: *Jun. 1, 2004**

(54) CARRIER FOR ELECTROPHOTOGRAPHIC DEVELOPER

(75) Inventors: Kimitoshi Yamaguchi, Numazu (JP); Masahide Yamashita, Numazu (JP); Akihiro Kotsugai, Numazu (JP); Hiroaki Takahashi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 87 days.

This patent is subject to a terminal disclaimer.

(21) Appl. No.: 10/135,377

(22) Filed: May 1, 2002

(65) Prior Publication Data

US 2003/0054279 A1 Mar. 20, 2003

(30) Foreign Application Priority Data

May 1, 2001 (JP) ..... P2001-134111
Apr. 30, 2002 (JP) ..... P2002-128265

(51) Int. Cl.[7] ..... G03G 9/00

(52) U.S. Cl. ..... 430/111.33; 430/111.35; 430/111.4; 430/111.41

(58) Field of Search ..... 430/111.33, 111.35, 430/111.4, 111.41

(56) References Cited

U.S. PATENT DOCUMENTS 5,512,402 A 4/1996 Okado et al.
5,655,199 A 8/1997 Yamashita et al.
5,774,775 A 6/1998 Aoto et al.
5,863,690 A 1/1999 Yamashita
5,873,018 A 2/1999 Aoto et al.
5,882,832 A 3/1999 Tosaka et al.
5,885,742 A 3/1999 Okado et al.
5,912,100 A 6/1999 Aoki et al.
6,004,715 A 12/1999 Suzuki et al.
6,010,814 A 1/2000 Kotsugai et al.
6,168,894 B1 1/2001 Aoki et al.
6,221,549 B1 4/2001 Emoto et al.
6,303,257 B1 10/2001 Hasegawa et al.
6,363,229 B1 3/2002 Shiraishi et al.
6,472,118 B1 * 10/2002 Yamaguchi et al. .... 430/111.35

FOREIGN PATENT DOCUMENTS

EP 0990954 4/2000
EP 1065571 1/2001
EP 1158366 11/2001

OTHER PUBLICATIONS

Communication, European Search Report Jul. 16, 2002.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A carrier for electrophotographic developer essentially consisting of a core material of magnetic particles and thereon provided a resinous coating layer, wherein a weight-average particle-diameter(Dw) of the carrier ranges from 25 to 45 μm, the content of particles having diameter less than 44 μm is more than or equal to 75% by weight, the content of particles having diameter more than or equal to 62 μm is less than one percent by weight, the content of particles having diameter less than 22 μm is less than or equal to 7.0% by weight, the magnetic moment of the carrier at 1 kilo Oe of magnetic field is more than or equal to 76 emu/g. The carrier shows high optical density of image with no smearing of background area, good reproducibility in developing of small dots in image with no carrier deposition.

22 Claims, 2 Drawing Sheets

CARRIER FOR ELECTROPHOTOGRAPHIC DEVELOPER

BACKGROUND OF THE INVENTION

1. Field of the Invention

The present invention relates to a carrier for electrophotographic developer, a developer using the carrier, a container for the developer, an image forming apparatus using the developer, an image forming method using the same and a preparation method of the carrier.

2. Description of the Related Art

There are proposed two developing methods in electrophotography; a so-called one-component developing method using one-component developer comprising merely toner as a main ingredient, and a two-component developing method using two-component developer comprising a mixture of a carrier made from materials such as glass beads, magnetic carrier, or those coated by resinous or other coatings, and a toner.

Two-component developing method is advantageous in comparison with one-component developing method, because it uses carrier which has large surface area causing good enough triboelectric-charge for toner, thereby charge of the toner is made stable, holding high quality in images for a long period of developing time. And as the two-component developing method shows a high ability in the supply of the toner to the developing area, there are many incidences having been employed particularly in high-speed apparatuses.

In digital electrophotographic system comprising steps of forming latent electrostatic images onto a photosensitive member by laser beam-irradiation and the like then developing the latent images, two-component developing method usable above characteristics is also being widely used.

Recently, size reduction and condensed distribution of dot units for latent image (pixcel units) have been designed to satisfy the requirements for improving the resolution degree, reproducibility of highlight image and faithful color-imaging. In, particular, important concern in the field is the achievement of developing system, which enables a faithful development of those latent images (dots composing each image). Therefore, many proposals were made from both points of processing means and developer (toner and carrier). As the processing means, a restriction of development gap and a slenderization of the layers composing photosensitive member are effective, however there are still remaining problems with regard to the processing means that the processing cost is increased as a result of such improvements, and sufficient reliability is not yet achieved, and the like.

On the other hand, with regard to developer, the dot reproducibility is considerably improved by use of small size of toner. However, problems are occurred with developer including small size of toners, such as a stain (or, in other word smear) in background area is generated, optical density in image is declined and others. And, in case of toner having small size which is used for full-color image, resins having a low softening-temperature are generally used which, in comparison with black toner, increase a spent amount on the surface of carrier, and degrade the quality of developer by time lapse and show a tendency apt to toner-scattering and to stain background area.

Various proposals for use of small size carriers are also proposed. For example, Japanese Patent No. 2832013 discloses a developing method for reversal development of a latent electrostatic image formed on a latent image-bearing member having organic photo-conductive layer, using magnetic brash of two-component developer which is held on a developer-bearing member and contains a toner capable of being charged in the same polarity as that of the latent image and a carrier; with imposing biased electric field having alter current component and direct current component, wherein the carrier is a carrier including ferrite core-material particles, the core-material particles are being coated with a electric insulating-resin and having a weight-average diameter ranging from 30 to 65 $\mu$m after coated with the resin, and the core-material particles have, at their surfaces, small bores of 1500 Å to 30000 Å in average size.

And Japanese Patent No. 3029180 discloses a carrier for electrophotographic developer using carrier particles, wherein the carrier particles have a size ranging from 15 to 45 $\mu$m in 50%-average diameter($D_{50}$) (the $D_{50}$ presents a particles amount summed up every ingredient divisions by size till becomes to 50%), the content of smaller carrier particles less than 22 $\mu$m in size ranges from 1 to 20%, the content of small carrier particles less than 16 $\mu$m in size is not higher than 3%, the content of large carrier particles more than or equal to 62 $\mu$m in size ranges from 2 to 15%, the content of larger carrier particles more than 88 $\mu$m in size is not higher than 2%, and the carrier satisfies a ratio($S_1/S_2$) of surface area($S_1$) measured by air-permeation method in comparison with surface area($S_2$), a range represented by;

$$1.2 \leqq (S_1/S_2) \leqq 2.0$$

where the $S_2$ represents surface area($S_2$) calculated from following Equation 1;

$$S_2=(6/\rho \cdot D_{50})\times 10^4 \qquad \text{Equation 1}$$

(where, the $\rho$ is specific gravity of the carrier).

Further, Japanese Unexamined Patent Publication of Tokkai Hei 10-198077 discloses a carrier for developer used for developing electrostatic latent image, wherein a 50%-average diameter($D_{50}$) in volumetric average diameter of the carrier ranges from 30 to 80 $\mu$m , a ratio($D_{50}/D_{10}$) of the $D_{50}$ for a 10%-average diameter($D_{10}$) in volumetric average diameter of the carrier is 1.8 or less, a ratio ($D_{90}/D_{50}$) of a 90%-average diameter($D_{90}$) in volumetric average diameter of the carrier for the 50%-average diameter ($D_{50}$) in volumetric average diameter of the carrier is 1.8 or less, the magnetic moment (at 1 kilo Oe of magnetic field) of the carrier ranges from 52 to 65 emu/g.

By the use of this kind of carriers having small diameter gives following benefits;

(1) Surface area per unit volume is large, therefore they can give good enough triboelectric-charge for each toner, and scarcely yield toners which have a low level of electric-charge and reverse polarity-charge too, accordingly, scattering of toner particles at the periphery of dot for image-forming and smear (blurring) in background area are few, thus dot reproducibility is excellent;

(2) Due to the nature of large surface area per unit volume and scarce to generate the smear in background area, a low level of average electric-charge in toner is allowable to use, notwithstanding, a high optical density of image is obtained, thus carrier of small diameter is capable to compensate the shortcomings which are caused by use of stall size of toner, hence is effective for driving out the advantages of small size of toner;

(3) As small diameter of carrier forms a dense magnetic brush and the head of the formed magnetic brush has an excellent fluidity, accordingly the trace drawn by dragging of the head of the magnetic brush on image is hardly imprinted.

However, carriers of small diameter in prior arts have a important problem that they are apt to deposit themselves on surfaces contacted with the developer, thus brings flaws on photosensitive member or fixing roller, therefore was difficult to utilize in practical.

With regard to carriers of small diameter, we, the inventor, have investigated diameters of carriers deposited on the surfaces of photosensitive member, and found out the facts that, out of used original carrier having a size-distribution, the smaller size of carrier particles show a tendency apt to deposit on the surface of photosensitive member preferentially, and the deposited ratio of smaller size of particles less than 22 $\mu$m diameter was overwhelmingly much in all deposited particles.

Accordingly, the first object of the present invention is to provide a carrier for electrophotographic developer and a developer using the same which are able to produce high quality of image-reproductions having an excellent dot-reproducibility, an excellent highlight-reproducibility, a high optical density of image, and showing a scarce or devoid of smear in background area.

The more object of the present invention is to provide a container for the developer.

The further object of the present invention is to provide an image-forming apparatus that is loaded the container for the developer.

The furthermore object of the present invention is to provide a preparation method of the carrier.

Above and other objects are achieved by the present invention comprising;

(1) A carrier for electrophotographic developer comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:
  (1) carrier component particles having a diameter of less than 44 micrometer in an amount of 75 wt. % or more,
  (2) carrier component particles having a diameter of 62 micrometer or more in an amount of less than 1 wt. %, and
  (3) carrier component particles having a diameter of less than 22 micrometer in an amount of 7.0 wt. % or less, based on the total amount of said carrier particles;

(2) A carrier for electrophotographic developer according to above paragraph (1), wherein said carrier component particles hang a diameter of less than 22 micrometer is in an amount of 3.0 wt. % or less;

(3) A carrier for electrophotographic developer according to above paragraph (1), wherein said carrier component particles having diameter of less than 22 micrometer is in an amount of 1.0 wt. % or less;

(4) A carrier for electrophotographic developer according to above paragraph (1), wherein the bulk density of the carrier is in degree of 2.2 g/cm$^3$ or more;

(5) A carrier for electrophotographic developer according to above paragraph (1), wherein the specific electric-resistance denoted by (log R·cm) of the carrier is in a value of 12.0 or more;

(6) A carrier for electrophotographic developer according to above paragraph (1), wherein the magnetic core particle is a MnMgSr ferrite material;

(7) A carrier for electrophotographic developer according to above paragraph (1), wherein the magnetic core particle is a Mn ferrite material;

(8) A carrier for electrophotographic developer according to above paragraph (1), wherein the magnetic core particle is a magnetite material;

(9) A carrier for electrophotographic developer according to above paragraph (1), wherein the resinous coating layer is a silicone resin coating layer;

(10) A carrier for electrophotographic developer according to above paragraph (1), wherein the resin layer comprises a resin layer containing a reaction product by amino silane type of coupling agents.

Further, above and other objects are also achieved by the present invention including;

(11) An electrophotographic developer using a toner and a carrier comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:
  (1) carrier component particles having a diameter of leas than 44 micrometer in an amount of 75 wt. % or more,
  (2) carrier component particles having a diameter of 62 micrometer or more in an amount of less than 1 wt. %, and
  (3) carrier component particles having a diameter of less than 22 micrometer in an amount of 7.0 wt. % or less, based on the total amount of said carrier particles;

(12) An electrophotographic developer using a toner and a carrier according to above paragraph (11), wherein the toner charge per mass is less than or equal to 35 $\mu$c/g at coverage ratio 50% on the surface of the carrier by the toner;

(13) An electrophotographic developer using a toner and a carrier according to above paragraph (11), wherein the toner charge per mass at 50% is less than or equal to 25 $\mu$c/g at coverage ratio 50% on the surface of the carrier by the toner;

(14) An electrophotographic developer using a toner and a carrier according to above paragraph (11), wherein the toner has a weight-average particle-diameter of less than or equal to 6.0 $\mu$m.

Furthermore, above and other objects are also achieved by the present invention including;

(15) A container for electrophotographic developer using a toner and a apparatus loaded with a carrier comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising;
  (1) carrier component particles having a diameter of less than 44 micrometer in an amount of 75 wt. % or more,
  (2) carrier component particles having a diameter of 62 micrometer or more in an amount of less than 1 wt. %, and
  (3) carrier component particles having a diameter of less than 22 micrometer in an amount of 7.0 wt. % or less, based on the total amount of said carrier particles.

Still further, above and other objects are also achieved by the present invention including;

(16) An image forming apparatus loaded with a container for electrophotographic developer, wherein the developer uses a toner and a carrier comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles.

Still further, above and other objects are also achieved by the present invention including;

(17) An image forming method using an electrophotographic developer, wherein the developer uses a toner and a carrier comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles.

Still further, above and other objects are also achieved by the present invention including;

(18) A preparation method of a carrier for electrophotographic developer comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles;

and comprising steps of (i) classifying a magnetic material of finely pulverized particles, thereby obtaining a core material of particles having a weight-average particle-diameter(Dw) of the carrier ranges from 25 to 45 $\mu$m, the content of particles having diameter less than 44 $\mu$m is more than or equal to 75% by weight, the content of particles having diameter more than or equal to 62 $\mu$m is less than one percent by weight, the content of particles having diameter less than 22 $\mu$m is less than or equal to 7.0% by weight, the magnetic moment of the carrier at 1 kilo Oe of magnetic field is more than or equal to 76 emu/g, (ii) providing a resinous film onto the magnetic core material;

(19) A preparation method of a carrier for electrophotographic developer comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles;

and comprising steps of (i) providing a resinous film onto a magnetic core material of finely pulverized particles, (ii) classifying the magnetic core material of finely pulverized particles having resinous film thereon, thereby obtaining a core material of particles having a weight-average particle-diameter(Dw) of the carrier ranges from 25 to 45 $\mu$m, the content of particles having diameter less than 44 $\mu$m is more than or equal to 75% by weight, the content of particles having diameter more than or equal to 62 $\mu$m is less than one percent by weight, the content of particles having diameter less than 22 $\mu$m is less than or equal to 7.0% by weight, the magnetic moment of the carrier at 1 kilo Oe is more than or equal to 76 emu/g;

(20) A preparation method of the carrier according to above paragraph (18), wherein a vibration sieve equipped with an ultrasonic wave-generator is used in the step of (i) classifying a magnetic material of finely pulverized particles;

(21) A preparation method of the carrier according to above paragraph (19), wherein a vibration sieve equipped with an ultrasonic wave-generator is used in the step of (ii) classifying the magnetic core material of finely pulverized particles having a resinous film thereon;

(22) A preparation method of the carrier according to above paragraph (20) or (21), wherein a vibration sieve, which is quipped with an ultrasonic wave-generator and a resonator ring to transfer ultrasonic waves generated by the ultrasonic wave-generator to the vibration sieve, is used in the step of classifying a magnetic material of finely pulverized particles.

The carrier for electrophotographic developer (it some times may merely described as the carrier hereinafter) of the present invention consists of a core material of magnetic particles and thereon provided a resinous layer.

With regard to the carrier of the present invention, weight-average particle-diameter(Dw) thereof ranges from 25 $\mu$m to 45 $\mu$m, favorably from 30 $\mu$m to 45 $\mu$m. Larger weight-average particle-diameter(Dw) than above range is hard to deposit the carrier, however the condensation of toner content in the developer for the sake of obtaining a high optical density of image increases smear (stain) of background area abruptly, and causes a large variance of dot diameter in case of development of small dot for latent image.

The carrier deposition in the present invention means a phenomenon of depositing carrier onto electrostatic latent image area or background area. The stronger electric field at both areas shows more abundance deposition of carrier. However image area is as a rule decreased in the strength of electric field by developing with toner, therefore is hard to deposit carrier in comparison with background area. As described forgoing, carrier deposition causes the flaws on photosensitive member or fixing roller, thus is unfavorable.

In the carrier of the present invention, the content of particles having diameter less than or equal to 44 μm is more than or equal to 70% by weight, favorably more than or equal to 75% by weight. And the content of particles having diameter less than or equal to 44 μm is favorably less than or equal to 95% by weight, more favorably less than or equal to 90% by weight. Within the content ratio of less than or equal to 95% by weight, one can obtained a carrier having desired size without excess expenditure.

The content of particles having diameter more than 62 μm is less than three percent by weight, favorably less than one percent. And the content of particles having diameter more than 62 μm is more than 0.3 percent by weight. Within the content ratio of more than or equal to 0.3% by weight, one can obtained a carrier having desired size without excess expenditure.

The larger content of particles having diameter more than 62 μm causes more noticeable scattering in dot sizes of latent image. It is thought that this tendency depends upon the fact that, in case of carrier particles having diameter more than 62 μm, small increase in size significantly influences to the reduction of percentage by weight of carriers having diameter ranging from 44 μm to 62 μm. The content of particles having diameter less than 22 μm is less than seven percent by weight, favorably less than three percent, more favorably less than one percent. The content of particles having diameter less than 22 μm is less than seven percent by weight, favorably less than three percent, more favorably less than one percent. And the content of particles having diameter less than 22 μm is more than or equal to 0.1 percent by weight. Within the content ratio of more than or equal to 0.1% by weight, one can obtained a carrier having desired size without excess expenditure.

In case of carrier having small diameter(size), a majority of carriers deposited are those fine particles having diameter less than 22 μm . We have evaluated carrier depositions with varied content ratios of smaller particles less than 22 μm diameter in small carrier particles of size ranging from 25 μm to 45 μm, and arrived to a conclusion that no serious problem is presented in the case of content of small particles less than 22 μm diameter is less than or equal to seven percent, and carrier deposition is improved by the content less than or equal to three percent, and more improved by restrict the content to a level less than or equal to one percent.

At the same time, it was found out that carrier deposition is also substantially evaded by controlling the magnetic moment of the carrier at 1 kilo Oe, to a level more than or equal to 76 emu/g.

The carrier of the present invention can prepared by pulverizing a magnetic material, classifying the finely pulverized particles so as to obtain a core material of particles having the defined average particle-diameter(Dw) and the defined distribution in average particle-diameters of the particles, then providing a resinous film onto the classified magnetic core material.

Above classification includes pneumatic classification, screen classification and the like. Vibration sieves have been used favorably, however conventional vibration sieve shows an inconvenience that it is apt to occur mesh-straggle (clogging) in case of classification for small size of particles, thus making inferior operation efficiency.

We have studied to develop a method capable of removal small size of particles with high efficient, and arrived to a result that small particles less than 22 μm diameter are removed efficiently and sharply by adding a vibration using ultrasonic wave to screen mesh in screen classification process.

The ultrasonic wave-vibration for vibrating the screen mesh can be obtained by giving an electric power of high frequency to a converter (transducer) which uses PZT vibrator and converts electric power to a ultrasonic wave generating vibration power. For making a vibration in screen mash, vibration of ultrasonic wave is transferred to a resonator member which is being fixed to the screen mesh, and the resonator member is resonated with the vibration of ultrasonic wave to make vibration for the screen mesh. Frequency of the ultrasonic wave for vibrating the screen mesh ranges from 20 to 50 K Hz, 30 to 40 K Hz is favorable. Form of the resonator member is allowed to be any one suitable to make vibration in the screen mesh, and generally is a ring form. Direction to make vibration of the screen mesh is favorably perpendicular to the surface of the screen mesh.

Figure 1:
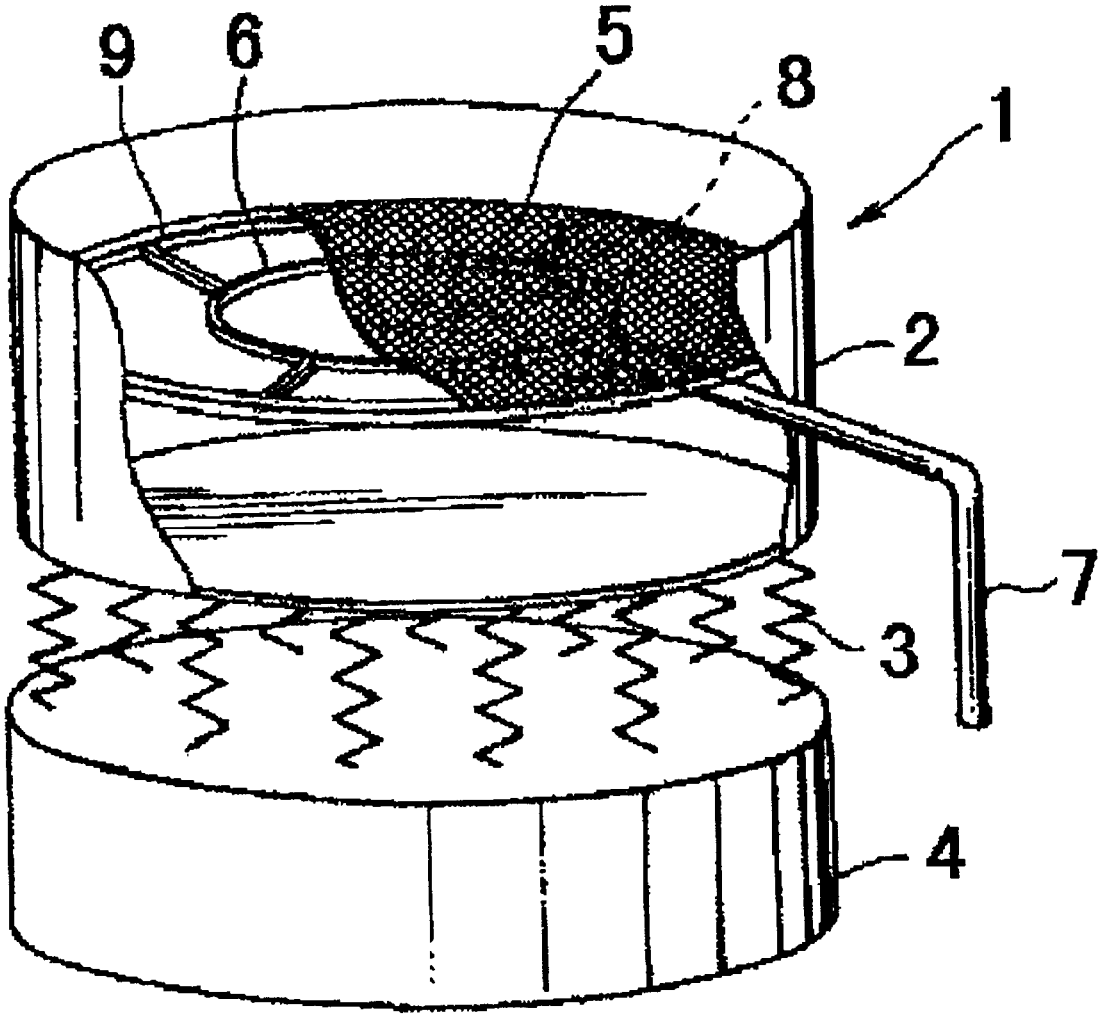
FIG. 1 is a perspective view of an embodiment of a vibration screen classifier equipped with an ultrasonic wave vibrator and favorably used in the present invention.

With regard to the classifier shown in FIG. 1, the vibration screen classifier (1) equipped with an ultrasonic wave generator (transducer) (8) and is connected with a supporting base (4) by springs (3). The vibration screen classifier (1) comprises a cylindrical housing (2) having a ring-wise inner frame (9) engaging spokes to support a resonator ring (6) which is fixed to a metal mesh (5) and to the ultrasonic wave generator (8) which is being connected with a cable (7) to supply high frequency electric power.

This vibration screen classifier (1) equipped with an ultrasonic wave generator (8) is driven by supplying a high frequency electric power, through cable (7), to the ultrasonic wave generator (8). The supplied high frequency electric power is, in the ultrasonic wave generator (8), converted to ultrasonic wave. The ultrasonic wave generated by generator (8) vibrates resonator ring (6) fixed to the ultrasonic wave generator (8) and to the ring-wise frame (9) on which the ultrasonic wave generator (8) is fixed, thereby the metal mesh (5) is vibrated in perpendicular direction to the surface of the screen mesh (5).

This type of vibration screen classifier equipped with an ultrasonic wave generator is now commercially available, for example, a commodity name as "ULTRASONIC" made by Koei Sangyo Co. Ltd. and the like are instanced.

Carrier according to the present invention can obtained by classifying a pulverized particles of magnetic material, or in case of provided is core materials such as ferrite or magnetite, they may be preliminarily formed in a first particles before sintering then classified, and sintered, classified if desired. Alternatively, the carrier may be prepared by providing at first a resinous layer onto the core material, then classified the resinous layer-provided particles. In this case it is favorable that the classifications in each step of the resinous layer-provided particles are conducted using above described vibration screen classifier equipped with an ultrasonic wave generator.

Core material used for constituting a carrier of the present invention includes various kind of known magnetic materials which have a magnetic moment, at 1 kilo Oe of magnetic field are being imposed, of the carrier a level more than or equal to 70 emu/g, favorably more than or equal to 76 emu/g, there is no upper limit of it in the present invention, however as a rule is 150 emu/g or the less. The magnetic moment smaller than above degree is unfavorable, because the carrier is apt to easily deposit.

Above described magnetic moment can be measured as follow.

With use of B-H Tracer (BHU-60 by Riken Denshi Co., Ltd.), 1 gram of carrier core particles are plugged in a cylindrical cell, which is being set on the apparatus. Thereto applied magnetic field is gradually increased until it reaches to 3000 Oe, then it is gradually decreased to zero Oe, after that, reverse polarity of magnetic field is applied and it gradually increased until it reaches to 3000 Oe, then it is decreased to zero Oe, next, the same polarity as that of initially applied magnetic field is again applied, thereby a B-H.curve (B means magnetic flux dencity and H is magnetic susceptibility) is drawn in a graph, and from the drawing, magnetic moment of the carrier core at 1000 Oe of magnetic field is calculated.

The core particle material used in the present invention which has a magnetic moment more than or equal to 70 emu/g at 1000 Oe of magnetic field includes for examples ferromagnetic substance such as iron cobalt, magnetite, hematite, Li type of ferrite, Mn—Zn type of ferrite, Cu—Zn type of ferrite, Ni—Zn type of ferrite, Ba type of ferrite, Mn type of ferrite, and the like. Ferrite is in general sintered substance shown by following Formula 2;

$$(MO)x(NO)y(Fe_2O_3)z \qquad \text{Formula 2}$$

(Where, x+y+z=100 mol %, and M, N means respectively Ni, Cu, Zn, Li, Mg, Mn, Sr, Ca and other relevant elements), consisting of perfect mixture of divalent metal oxide and ferric oxide.

As examples of favorable core particle material used in the present invention which has a magnetic moment more than or equal to 76 emu/g at 1000 Oe of magnetic field is instanced as iron, magnetite, Mn—Mg—Sr type of ferrite, Mn type of ferrite, and the like.

Bulk density of the carrier more than or equal to 2.2 g/cm$^2$, favorably more than or equal to 2.3 g/cm$^3$ is advantageous for preventing the carrier deposition. Carrier of small bulk density is in general porous or plenty of surface concavo-convex. Smaller bulk density of the carrier is more disadvantageous for preventing the carrier deposition because even if the carrier has large amount of magnetic moment (emu/g) at 1000 Oe of magnetic field, substantial value of magnetic moment per particle is reduced. And plenty of concavo-convex causes a different thickness of resin coating by location, therefore unevenness of electric charge and electric resistance by location is likely to occur, effecting durability and carrier deposition for long period of running time.

Specific resistance (log R·cm) of the carrier in the present invention is 12.0 or more, favorably 13.0 or more. The specific resistance less than above described degree is unfavorable, because in the case where the developing gap (the most closed distance between photosensitive member and development sleeve) becomes narrower, di-polarized electric charge is apt to be induced in the carrier, hence is apt to occur the carrier deposition. A tendency of the deterioration is shown in case of large linear velocity of photosensitive member and of large linear velocity of development sleeve are conducted, and when a biased AC voltage is applied the tendency becomes more significant. Usually, carrier for toner used in color developing is in general a carrier having low electric resistance. It has been now understood that the carrier of the present invention having above described degree of specific resistance, under the circumstance used in accompanied with a toner having a relevant amount of electric charge, yields an enough optical density of images.

The specific resistance of the carrier in the present invention can be measured by a method described below.

Figure 2:
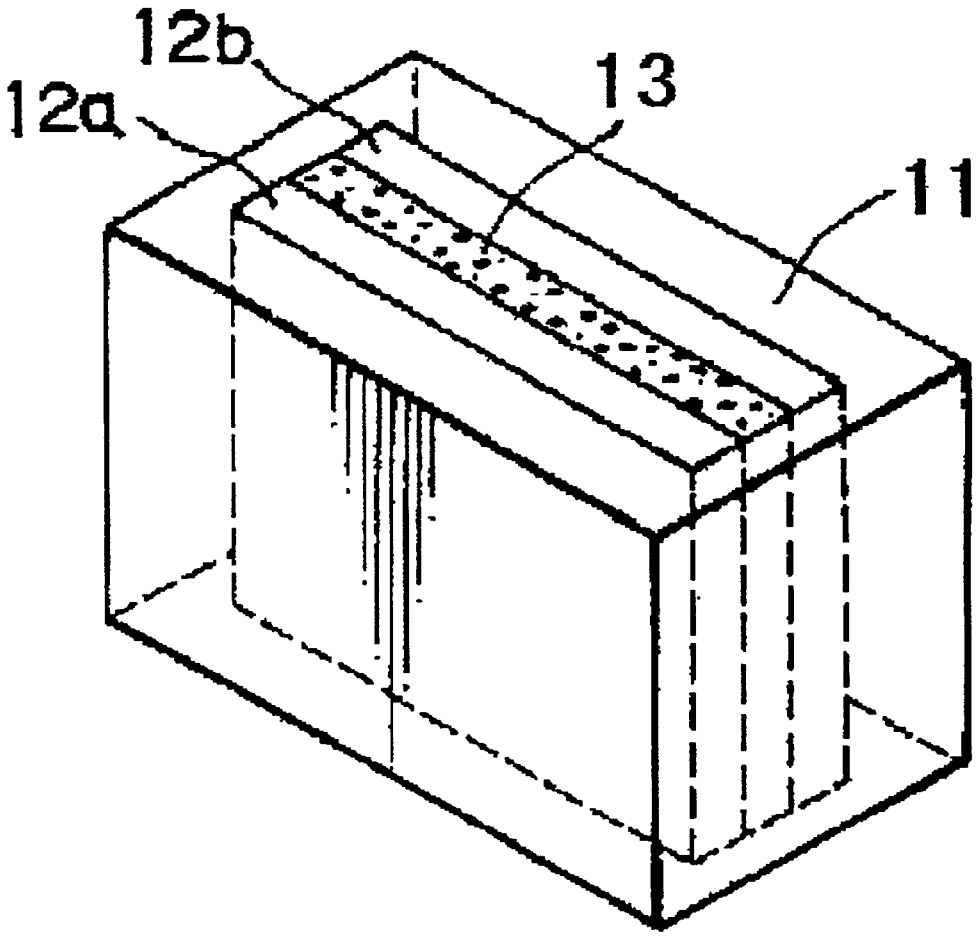
FIG. 2 is a perspective view of an electric resistance-measuring cell used for measuring the electric resistance of the carrier according to the invention.

As shown FIG. 2, carrier (13) was filled in a cell which is made of fluoride resin and therein has electrodes (12*a*)(12*b*) of 2 mm distance and 2×4 cm of surface area, then DC electric voltage of 100 V was applied between the electrodes to determine a DC electric resistance which is shown on High Resistance Meter 4329A (4329A+LJK, 5HVLVWDQFH OHWHU manufactured by Yokogawa Hewlett-Packard Co. Ltd.) and to calculate the specific resistance (log R·cm) of the carrier.

Adjustment of the specific resistance (log R·cm) of the carrier is able to execute by controlling of electric resistance and layer thickness of the resin to be coated upon carrier-core material. And it is possible to adjust the specific resistance of the carrier by adding a conductive finely divided powder into the coating resin. As the conductive finely divided powder, metal or metal oxide powders such as ZnO powder and Al powder, $SnO_2$ prepared by various methods or doped by various elements, borides such as $TiB_2$, $ZnB_2$, $MoB_2$, silicon carbide, conductive polymers such as poly(acethylene), poly(parapenylene), poly(parapenylene-sulfide) poly pyrrole, electro-conductive polyethylene, carbon blacks such as furnace black, acethylene black, channel black, are instanced.

Those conductive finely divided powders may uniformly be dispersed by following manner; namely, by adding the conductive finely divided powder into a solvent used for coating or a resinous solution for coating, and admixing the solvent or solution by using dispersing apparatus or stirrer equipped with paddles ratable with high revolution speed.

The carrier of the present invention is prepared by providing a resinous layer onto the surface of the particles of core material. As resin materials for forming the resinous layer, a silicon resin including the repeating units of formulas represented below is favorably used in the present invention;

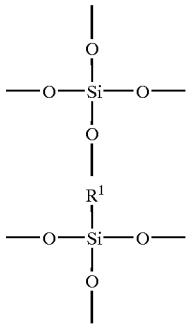

and

-continued

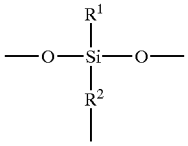

(where, $R^1$ indicates hydrogen atom, halogen atom, hydroxy group, methoxy group, lower alkyl group comprising 1 to 4 of carbon atoms, or aryl group such as phenyl group and tryl group, $R^2$ indicates alkylene group comprising 1 to 4 of carbon atoms, or arylene group such as phenylene group and trylene group).

Straight silicone resins may be used in the present invention. As examples of those resins are instanced as KR271, KR272, KR282, KR252, KR255 and KR152 (all which are made by Shin-Etsu Chemical Co. Ltd.), SR2400, SR2406 (those are made by Dow Corning Toray Co., Ltd.).

Modified silicone resins are also may be used in the present invention. Those are exemplified as epoxy resin-modified silicone, acrylic resin-modified silicone, phenollic resin-modified silicone, urethane-modified silicone, polyester resin-modified silicone, and alkyd resin-modified silicone resins.

Specified examples thereof are instanced ES-1001N as the epoxy-modified, KR-5208 as the acrylic-modified, KR-5203 as the polyester-modified, KR206 as the alkyd modified, KR-305 as the urethane-modified (all which are made by Shin-Etsu Chemical Co. Ltd.), SR-2115 as the epoxy-modified, SR-2110 as the alkid-modified (those are made by Dow Corning Toray Co., Ltd.).

Above mentioned silicone resin used in the present invention may contain a relevant amount (0.001 to 30% by weight) of amino-silane coupling agent comprising (this is a basis of reason why above description says 'essentially consisting of'), for examples as follow.

$H_2N(CH_2)_3.Si(OCH_3)_3$ MW 179.3

$H_2N(CH_2)_3.Si(OC_2H_5)_3$ MW 221.4

$H_2N\cdot.CH_2.CH_2.CH_2.Si(CH_3)_2.(OC_2H_5)$ MW 161.3

$H_2N.CH_2.CH_2.CH_2.Si(CH_3).(OC_2H_5)_2$ MW 191.3

$H_2N.CH_2.CH_2.HN.CH_2.Si(OCH_3)_3$ MW 194.3

$H_2N(CH_2)_2.HN.(CH_3)_3.Si(CH_3).(OCH_3)_2$ MW 206.4

$H_2N(CH_2)_2.HN.(CH_2)_3.Si(OCH_3)_3$ MW 224.4

$(CH_3)_2.N.(CH_2)_3.Si(CH_3).(OC_2H_5)_2$ MW 219.4

$(C_4H_9)_2.N.(CH_2)_3.Si(OCH_3)_3$ MW 291.6

Furthermore, in the present invention, following resins can be employed as a coating material for coating the carrier core particles alone or in combination with silicone resin; Resin of Stylene type including poly styrene, poly (chlorostyrene), poly-α-methylstyrene, stylene-chlorostyrene copolymer, styrene-propylene copolymer, styrene-butadiene copolymer, styrene-vinyl chloride copolymer, styrene-vinyl acetic acid copolymer, styrene-maleic acid copolymer, styrene-acrylic acid ester copolymer (such as styrene-methyl acrylate copolymer, styrene-ethyl acrylate copolymer, styrene-butyl acrylate copolymer, styrene-octyl acrylate copolymer, styrene-phenyl acrylate copolymer), styrene-methacrylic acid ester copolymer (such as styrene-methyl methacrylate copolymer, styrene-ethyl methacrylate copolymer, styrene-butyl methacrylate copolymer, styrene-phenyl methacrylate copolymer), styrene-metyl-α-chloracrylate copolymer, styrene-acrylonitrile-acrylic acid ester copolymer, epoxy resin; polyester resin, polyethylene resin, polypropylene resin, ionomer resin, polyurethane resin, ketone resin, ethylene-ethyl acrylate copolymer, xylene resin, polyamido resin, phenollic resin, polycarbonate resin, melamine resin, fluorine-containing resin and the like.

With regard to the method of providing the resinous layer onto surface of the carrier core particles, various known methods are applicable such as spray drying method, dipping method, powder coating method and the like, in particular, fluid bed type of coating apparatus is effective for obtaining uniform coating film in the present invention.

The thickness of the resinous film provided onto the carrier core particles is as a rule in the range from 0.02 to 1.0 μm, favorably from 0.03 to 0.8 μm . This thickness of the resinous film is extremely thin, therefore size distributions of both the coated carrier core particles and source carrier core particles are substantially same.

Developer of the present invention essentially consists of above mentioned carrier and toner. Toner used in the present invention is a mixture of coloring agent, finely divided particles, charge-controlling agent, repellant (in other words, releasing agent) and the like which are having been contained in binder resins as mainly thermoplastic resin in conventional toner, and various known toners can employ as the toner, and may be toners of irregular form or spherical form which are prepared by various method such as polymerization, pulverization, milling and so on. They may be magnetic toner and non-magnetic toner.

Binder resin of the toner includes those as below which can employed alone or in combination.

As styrene type of binder resins include for examples homopolymer of stylene and its derivatives (such as polystyrene, polyvinyltoluene), copolymer (such as styrene-p-chlorostyrene copolymer, styrene-propylene copolymer, styrene-vinyltoluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-metyl-α-chloromethacrylate copolymer, styrene-acrylonitrile copolymer, styrene-vinylmethylether copolymer, styrene-vinylmethylketone copolymer, styrene-butadiene copolymer, styrene-isoprene copolymer, styrene-maleic acid copolymer, styrene-maleic acid ester copolymer.

As acrylic resin includes for examples poly methyl methacrylate, poly butyl methacrylate.

And as others include for examples poly vinyl chloride, poly vinyl acetic acid, polyethylene, polypropylene, polyester, polyurethane, epoxy resin, polyvinyl butyral, poly acrylic acid resin, rosins, modified rosin, terpenic resin, phenollic resin, resin of aliphatic or cycloaliphatic hydrocarbon type, aromatic petroleum resin, chlorinated paraffin, paraffin wax.

The polyester resin can, in comparison with styrene type of resin and acrylic resin, decrease the viscosity where it is melted, while is holding the stability in storage. This kind of polyester resin is obtained by for example polycondensation reaction of alcohol and carboxylic acid.

The alcohol includes diols (such as poly(ethylene glycol), diethylene glycol, triethylene glycol, 1,2-propylene glycol, 1,3-propyleneglycol, 1,4-propylene glycol, neo-pentyl glycol, 1,4-butene diol; 1,4-bis-hydroxy-methyl cyclohexane, bisphenol A, hydrogenated bisphenol A, etherificated bisphenols such as polyoxyethylene group-introduced bisphenol A and polyoxypropylene group-introduced bisphenol A, divalent alcoholic monomers which are derived from above each diols and are being substituted by saturated or unsaturated hydrocarbon group(s) having 3 to 22 of carbon atoms, other divalent alcohols), triols (such as 1,2,4-butanetriol, 1,2,5-pentanetriol, glycerol, 2-methyl propanetriol, 2-methyl-1,2,4-butanetriol, trimethylol ethane, trimetholpropane, 1,3,5-trihydroxymethylbenzene), sorbitol, 1,2,3,6-hexane tetrol, 1,4-sorbitan, pentaerythritol, di-pentaerythritol, tri-pentaerythritol, saccharose.

The carboxylic acid employed for obtaining the polyester resin includes monocarboxylic acid (such as palmitic acid, stearic acid, oleic acid), dicarboxylic acid monomer (such as maleic acid, fumalic acid, mesaconic acid, citraconic acid, terephthalic acid, cyclohexane-dicarboxylic acid, succinic acid, adipic acid, sebatic acid, malonic acid, organic dibasic carboxylic acid which is derived from above each dicarboxylic acid and is being substituted by saturated or unsaturated hydrocarbon group(s) having 3 to 22 of carbon atoms, anhydrides thereof, dimer derived from loweralkylester and linoleic acid), tribasic acid (such as 1,2,4-benzenetricarboxylic acid, 1,2,5-benzene tricarboxylic acid, 2,5,7-naphthalenetricarboxylic acid, 1,2,4-naphthalene tricarboxylic acid, 1,2,4-butanetricarboxylic acid, 1,2,5-hexane tricarboxylic acid, 1,3-dicarboxyl-2-methyl-2-methylenecarboxy propane, anhydrides thereof), polycarboxylic acid monomer of more than tribasic acid (such as tetra methylenecarboxyl methane, 1,2,7,8-octatetracarboxylic acid enbol trimer, anhydrides thereof).

As resin of epoxy type used in the present invention includes polycondensation products between bisphenol A and epodhlohydrin, a part of which are commercially available as Epomick R362, R364, R365, R366, R367 and R369, they are made by Mitsui Petrochemical Co. Ltd., EpoToto YD-01, YD-012, YD-014, YD-904, YD-017 made by Toto Chemical Co., EPOCOAT 1002, 1004, 1007 made by Schell Kagaku K. K.

Suitable materials as the coloring agent in the present invention include but are not limited to carbon black, lamp black, iron black, ultramarine, nigrosine, aniline black, phthalocyanine blue, Hansa yellow G, Rhodamine 6G lake, chalco-oil blue, chrome yellow, quinacridone, benzidine yellow, rose bengale, triarylmethane dyes, mono-azo or di-azo pigments and other known dyes and pigments.

The toner may be used as a magnetic toner by incorporating a magnetic material powder therein. For this purpose the magnetic material may be a ferromagnetic substance such as metallic iron and cobalt, powders of magnetite, hematite, Li type ferrite, Mn—Zn ferrite, Cu—Zn ferrite, Ni—Zn ferrite, Ba type ferrite and other magnetic materials.

The toner composition of the present invention may also includes such additional materials as charge (or in other words, so-called tribo-electric charge) controlling agents which are exemplified as metallic complexes such as mono-azo dyes, nitrohumic acid and salts thereof, amino compounds of Co, Cr, of Fe metal complexes with salicylic acid, naphthoic acid or dicarboxylic acid, quarternary ammonium compounds and organic dye materials.

The toner composition of the present invention may also includes repellant, when necessary. Examples of such repellant include but not limited to low molecular weight polypropylene, low molecular weight polyethylene, carnauba wax, micro-crystalline wax, jojoba wax, rice wax and montan wax, and these waxes are used alone or in combination.

The toner also may contain additives if desired. It is required for excellent quality of image to provide to the toner with a sufficient fluidity. For this purpose, to the toner an exterior addition of a fluidity improving agent such as finely divided powders of metallic oxides which are having been hydrophobic treated or fine powder of lubricant to the toner is effective, and additives such as metallic oxide, finely divided powders of organic resin and metallic soaps may be employable. Illustrative examples thereof are a lubricant such as poly(tetrafluoro-ethylene) resin and zinc stearate, an abrasive such as cerium oxide or silicon carbide, a fluidity improving agent consisting of inorganic oxides such as $SiO_2$ and $TiO_2$ powders which are having been hydrophobic treated, a material known as anti-caking agent such as colloidal silica, aluminum oxide, and hydrophobic treated materials therefrom, and in particular hydrophobic silica is favorable for improving the fluidity of the toner.

The toner used in the present invention has a weight-average particle-diameter (Dt) ranging from 9.0 to 4.0 μm, favorably from 7.5 to 4.5 μm. A ratio of the toner for carrier ranges from 2 to 25 weight parts, favorably from 4 to 15 weight parts of the toner per 100 weight parts of the carrier.

In developer of the present invention consisting of the carrier and the toner, coverage ratio by the toner for the carrier is 10 to 80%, favorably 20 to 60%. And in the developer of the present invention, when the coverage ratio by the toner for the carrier is 50%, the toner charge per mass is less than 35 μc/g, favorably less than 25 μc/g. There is no the lowest limit of the toner charge per mass, however as a rule is about 15 μc/g or so. Less than 35 μc/g of the toner charge per mass causes a high optical density of image reproduced, and less than 25 μc/g of the toner charge per mass gives higher optical density of the image hence resulting more excellent quality in the image.

The coverage ratio by the toner for the carrier is represented by Equation 3 as bellow.

$$\text{Coverage ratio } (\%)=(Wt/Wc)\times(\rho c/\rho t)\times(Dc/Dt)\times(1/4)\times 100 \quad \text{Equation 3}$$

Where, the Wt is toner weight(g), the Wc is carrier weight(g), the ρc is true density of the carrier (g/cm$^3$), the ρ t is the density of the toner (g/cm$^3$), the Dc is weight average particle diameter of the carrier (μm), the Dt is weight average particle diameter of the toner (μm).

Weight average particle diameters (Dw) of the carrier, which is related to both carrier core and toner in the present invention, are values calculated from the basis obtained by measuring the particle size-distributions (showing the frequencies of particle number by particle diameter-division). The weight particle diameters (Dw) are represented by Equation 4 as below.

$$Dw=\{1/\Sigma(nD^3)\}\times\{\Sigma(nD^4)\} \quad \text{Equation 4}$$

Where, the D is a representative particle size (μm) by each cannel having own size figure, the n is total number of the particles detected in the each channel.

The channel mentioned above is an unit for dividing the abscissa axis indicating particle size in the graph showing of whole particle size-distribution, and each channel has 2 μm wide in case of the present invention. The representative particle size by each channel was designated as the smallest size in the each channel in case of the present invention.

Above mentioned particle diameters in the present invention were measured using Micro-Track particle size analyzer (model HRA 9320-X 100 made by Honewell Co. Ltd), with following measuring conditions.

(1) Scope of particle size: 8 to 100 μm (2) Channel width: 2 μm (3) Number of the channel: 46

(4) Particle Refractive Index: 2.42

The container for electrophotographic developer of the present invention is a developer-container containing the developer of the present invention therein. Various kinds of known containers may be used as the container.

The image-forming apparatus of the present invention is an apparatus using, as developer-container, a container of the present invention. Various kinds of known image-forming apparatuses may be used as the apparatus.

The image-forming method of the present invention is a method using, as developer, a developer of the present invention. Various kinds of known image-forming apparatuses may be used as the apparatus.

In this case a high quality of image having high optical density in the image with devoid of or scarce smear in back ground area can be produced by applying, as a biased electric-power to be added from external source during developing, a DC voltage overlapped by AC voltage. In particular, dot-reproducibility and reproducibility of half-tone area are improved. Application of the DC voltage overlapped by the AC voltage makes in general substantially large electric-potentials in both development point and back-ground area, in comparison with the case of only DC voltage is applied. Therefore carrier depositions were apt to occur in conventional arts, however the carrier of the present invention makes possible to be compatible achievements of high optical density of image and avoidance of carrier deposition.

And, among the carrier of the invention having small diameter is used, if a small diameter carrier having a defined narrow particle-distribution noted as above is used, then a high quality image of excellent dot-reproducibility with very scarce or eliminated smear in back ground area and very scarce carrier deposition.

Having generally described this invention, further understanding can be obtained by reference to following specific examples which are provided herein for the pupose of illustration only and are not intended to be limiting. In the descriptions in the following examples, file numbers represent weight ratios unless otherwise specified.

EXAMPLES

Preparation of Toners

Preparation of Toner 1

| | |
|---|---|
| Poly ester resin | 100 parts |
| Magenta dye of quainacridone type | 3.5 parts |
| Fluorine-containing quaternary ammonium salt | 4 parts |

Above ingredients were thoroughly mixed using a Bender then melted and kneaded by a bi-axial extruder, allowed to cool, coarsely pulverized by a cutter mill, then finely pulverized by a jet pneumatic fine mill and classified by a pneumatic classifier, thus obtained a mother toner particles having 7.6 $\mu$m of weight average diameter, 1.20 g/cm$^3$ of true specific gravity.

To 100 parts of this mother toner was added by 0.8 parts of hydrophobic silica fine particles (R 972; made by Aerosil Japan Co. Ltd.) to obtain Toner I.

Preparation of Toner 2

Toner II having 5.8 $\mu$m of weight average diameter, 1.20 g/cm$^3$ of true specific gravity was prepared from steps of preparing a mother toner by similar method as that of described Preparation of Toner 1, then adding 1.0 part of the hydrophobic silica particles (R 972; made by Aerosil Japan Co. Ltd.).

Preparation of Carriers

Preparation of Carrier 1

Silicon resin (SR2411 made by Toray Dow-corning Ltd.) was diluted to a silicon resin solution (containing 5% of solid).

This solution was coated onto 5 kg of Carrier Core (i) having characteristics shown in Table I bellow (Mn—Mg—Sr type ferrite having 77 emu/g of magnetic moment at 1 kilo Oe) by using a fluidized bet-type of coating apparatus at rate of approximately 40 g/min., in an atmosphere at 100° C., and the coated were followed by heating for two hours at 240° C., thus Carrier A having 5.0 g/cm$^3$ of true specific gravity and 0.53 $\mu$m of coated layer thickness was obtained. Controlling of the thickness in the coated layer was conducted by adjusting the introducing amount of the coating liquid.

Preparation of Carrier 2

Similar method as that of described in Preparation of Carrier 1 was repeated with exception of using Carrier Core (ii) shown in Table I, to obtain Comparative Carrier B having 0.51 $\mu$m of coated layer and 5.0 g/cm$^3$ of true specific gravity.

Preparation of Carrier 3

Similar method as that of described in Preparation of Carrier 1 was repeated with exception of using Carrier Core (iii) shown in Table I, to obtain Comparative Carrier C having 0.52 $\mu$m of coated layer and 5.0 g/cm$^3$ of true specific gravity.

Preparation of Carrier 4

Similar method as that of described in Preparation of Carrier 1 was repeated with exception of using Carrier Core (iv) shown in Table I, to obtain Comparative Carrier D having 0.53 $\mu$m of coated layer and 5.0 g/cm$^3$ of true specific gravity.

Preparation of Carrier 5

Similar method as that of described in Preparation of Carrier 1 was repeated with exception of using Carrier Core (v) shown in Table I (74 emu/g of magnetic moment at 1 kilo Oe), to obtain Comparative Carrier E having 0.51 $\mu$m of coated layer and 5.0 g/cm$^3$ of true specific gravity.

Preparation of Carrier 6

Similar method as that of described in Preparation of Carrier 1 was repeated with exception of using Carrier Core (vi) shown Table I, to obtain Carrier F having 0.51 $\mu$m of coated layer and 5.0 g/cm$^3$ of true specific gravity.

Preparation of Carrier 7

Similar method as that of described in Preparation of Carrier 1 was repeated with exception of using Carrier Core (vii) shown in Table I, to obtain Carrier G having 0.50 $\mu$m of coated layer and 5.0 g/cm$^3$ of true specific gravity.

Preparation of Carrier 8

Similar method as that of described in Preparation of Carrier 1 was repeated with exception of using Carrier Core (viii) shown in Table I, to obtain Carrier H having 0.63 $\mu$m of coated layer and 5.0 g/cm$^3$ of true specific gravity.

Preparation of Carrier 9

Silicon resin (SR2411 made by Toray Dow-corning Ltd.) was diluted to a silicon resin solution (containing 5% of solid). To the solution was added an amino silane coupling agent having a structure shown by $H_2N—(CH_2)_3—Si—(OC_2H_5)_3$ at the ratio of 3 weight percent for the solid resin in the solution.

Then the solution was coated onto 5 kg of Carrier Core (i) having characteristics shown in Table I bellow (Mn—Mg—Sr type ferrite having 77 emu/g of magnetic moment at 1 kilo Oe) by using a fluidized bet-type of coating apparatus at rate of approximately 40 g/min., in an atmosphere at 100° C., and the coated were followed by heating for two hours at 230° C., thus Carrier I having 5.0 g/cm$^3$ of true specific gravity and 0.52 $\mu$m of coated layer thickness was obtained. Controlling of the thickness in the coated layer was conducted by adjusting the introducing amount of the coating liquid.

Preparation of Carrier 10

Silicon resin (SR2411 made by Toray Dow-corning Ltd.) was diluted to a silicon resin solution (containing 5% of solid). A carbon black (having a registered trademark of Ketjen Black EC-DJ600 made by Lion Akzo Co. Ltd.) of 3 weight % and an amino silane coupling agent having a structure shown by $H_2N—(CH_2)_3—Si—(OC_2H_5)_3$ of 5 weight % for the solid resin weight were added into the solution, which was then dispersed for 60 minutes by a ball mill.

Obtained solution was coated onto 5 kg of Carrier Core (i) having characteristics shown in Table I by using a fluidized bet-type of coating apparatus at a supplying rate of approximately 40 g/min., atmospheric condition was at 100° C. And the coated were followed by heating for two hours at 230° C., thus Carrier J having 0.50 μm of coated layer thickness and 5.0 g/cm$^3$ of true specific gravity was obtained. Controlling of the thickness in the coated layer was conducted by adjusting the introducing amount of the coating liquid.

Preparation of Carrier 11

Similar method as that of described in Preparation of Carrier 1 was repeated with exception of using Carrier Core (ix) shown in table I (Mn ferrite having 83 emu/g of magnetic moment at 1 Kilo Oe), to obtain Carrier K having 0.51 μm thickness of coated layer and 5.0 g/cm$^3$ of true specific gravity.

Preparation of Carrier 12

Similar method as that of described in Preparation of Carrier 1 was repeated with exception of using Carrier Core (x) shown in Table I (Magnetite having 81 emu/g of magnetic moment at 1 Kilo Oe), to obtain Carrier L having 0.53 μm thickness of coated layer and 5.0 g/cm$^3$ of true specific gravity;

Preparation of Carrier 13

Similar method as that of described in Preparation of Carrier 9 was repeated with the exception of adopting the heating temperature of 260° C. after coated, to obtain Carrier M having 0.52 μm thickness of coated layer and 5.0 g/cm$^3$ of true specific gravity.

Preparation of Carrier 14

Similar method as that of described in Preparation of Carrier 9 was repeated with the exception of adopting the heating temperature of 300° C. after coated, to obtain Carrier N having 0.52 μm thickness of coated layer and 5.0 g/cm$^3$ of true specific gravity.

Preparation of Carrier 15

Carrier Core Material (i) shown in Table I of 5 Kg was vibrated to classify using a vibration screen classifier equipped with an ultrasonic wave generator, to obtain Carrier Core (xi) shown in Table I. The vibration screen classifier is a classifier shown in FIG. 1, which is a sieving apparatus equipped with an ultrasonic wave generator (transducer) (8) generating ultrasonic waves having frequency of 36 K Hz as a vibrator which is provided on a resonator ring (6) contacted with a metal screen (5) having 70 cm diameter and 635 mesh openings which is supported by a frame (9). The metal screen (5) is provided in a cylindrical container (2) which is supported by a base member (4) through springs (3). There is provided a vibrating motor which is not shown in the FIG. 1, while generates a high frequency electric current by driving thereof, and generated electric current is, via cable (7), transferred to the ultrasonic wave generator (8) fixed in the resonator ring (6), thereby ultrasonic waves are generated. By the ultrasonic waves, the resonator ring (6) is vibrated, thereby the metal mesh (5) is vibrated in perpendicular direction to the surface of the screen mesh (5). Thus classified Carrier Core Material was recovered as Carrier Core XI from the upside of the screen mesh (5). There was no clogging of mesh (5). By using the vibration screen classifier, content ratio of small size less than 22 μm was able to decrease from 6.2 weight % to 0.6 weight %, with yielding of 93 weight %. Using this Carrier Core Material, Coated Carrier O was obtained by similar method as that of described in Preparation of Carrier 1.

Preparation of Carrier 16

Comparative Carrier D prepared in Preparation of Carrier 4 from Carrier Core (iv) was classified (removal of finer particles) using the vibration screen classifier used in above Preparation of Carrier 15, to obtain a Carrier D' of the present invention having diametric characteristics shown in Table I. was obtained. Carrier Core (iv) for Carrier D was a core material containing 8.5 weight % of small size less than 22 μm, in Carrier D' as a classified resultant, the content ratio 8.5 weight % of small size less than 22 μm was decreased to 0.5 weight %. There was no clogging of mesh (5).

Preparation of Developers and Evaluations of the Same

Various developers were prepared using Toners I and II obtained from Preparation of Toners 1 and 2, and Carriers A to D' obtained from Preparation of Carriers 1 to 16.

Also, Images were reproduced using the various developers, and many qualities of the images were identified and characteristics such as reliabilities thereof and other performances were examined.

The images were reproduced in following conditions using Imagio Color 4000 (registered trademark of a copy machine having digital color image printing function manufactured by Ricoh Co. Ltd.)

Developing gap (photosensitive member—developing sleeve); 0.40 mm

Doctor gap (developing sleeve—doctor); 0.70 mm

Linear speed of photosensitive member; 200 mm/sec.

Ratio of linear speeds (of developing sleeve/of photosensitive member)=1.50

Imprinting density of the dots (pixels); 600 dpi

Charged electric potential (Vd); −700V

Electric potential(V1) at image part(solid area) presented by light irradiation; −150 V Developing biased potential; DC −600V/AC bias component of 2 KHz, −200V to −1000 V, and 50% duty)

Evaluations of the images reproduced were conducted on transferring paper sheets, while evaluations of carrier depositions were conducted by observation of the states on photosensitive member after developed and before transferring.

Adopted Examination methods in following Examples were as below.

(1) average dot diameter and/variance of dot diameter thereof; One dot images were printed, and 16 dots at every 5 regions were measured, average diameter of total 80 dots and vice of dot diameter (σ) were determined (latent dot images were printed at main scanning direction 200 lines× sub-scanning direction 200 lines in printer mode so as to make a pattern ●○○ ●○○ array)

(2) Evaluation of uniformity of halftone area; Granularity (range of lightness=50 to lightness=50 to 80) defined by Equation 5 was measured.

$$\text{Granularity}=\exp\ (aL+b)\int (WS(f))^{1/2}VTF(f)df \qquad \text{Equation 5}$$

Where, the L is average lightness, the f means spatial frequency (cycle/mm), the WS(f) means power spectrum of lightness changes, the VTF(f) means visual spatial modulation transfer function, and the a, the b are coefficients, respectively And the measured values were allotted to following Grades (Grade 10 is the best)

Grade 10; 0 to 0.1

Grade 9; 0.1 to 0.2

Grade 8; 0.2 to 0.3

Grade 7; 0.3 to 0.4

Grade 6; 0.4 to 0.5

Grade 5; 0.5 to 0.6

Grade 4; 0.6 to 0.7

Grade 3; 0.7 to 0.8

Grade 2; 0.8 to 0.9

Grade 1, more than or equal to 0.9

(3) Optical density of images; 5 images located in central parts of every 30 mm×30 mm solid image areas reproduced in above described conditions were measured by X-Rite 938 spectral densitometer, to calculate an average value of density.

(4) Smear of background area; Background areas being suffered from above described image reproducing conditions were evaluated by following 10 Grades (Grade 10 is the best).

Evaluation is made by counting the number of deposited toners on the background areas of the transferring paper sheets, to calculate the number of deposited toners per 1 $cm^2$. Relationships between Grades and toner number deposited (per 1 $cm^2$) were as below.

Grade 10; 0 to 36

Grade 9; 37 to 72

Grade 8; 73 to 108

Grade 7; 109 to 144

Grade 6; 145 to 180

Grade 5; 181 to 216

Grade 4; 217 to 252

Grade 3; 253 to 288

Grade 2; 289 to 324

Grade 1; more than or equal to 325

(5) Carrier deposition; electric potential of background area Generation of carrier depositing causes the flaws on photosensitive drum or fixing roller, therefore decreases image quality. As only one part of deposited carriers are in general transferred to the transferring paper, the carrier deposition states were directly observed on photosensitive drum. And generation of carrier depositions are varied by image patterns, therefore the improbabilities of carrier depositions were evaluated by following manner.

Namely, developments of background areas (not irradiated areas) were repeated in the states where developing bias (Vb) was fixed at DC −600 V while charging potential (Vd) were shifted in a manner of increasing from −700V, to −750V, then to −800V and so on, thereby a charging potential (Vd) where initiating carrier deposition was detected.

Potential values calculated from Vb−Vd were evaluated as the background potentials for initiating generations of carrier depositions. Larger value shows more improbable in carrier deposition. In the evaluation, AC bias component of ±400 V (2 KHz of frequency, 50% duty) was overlapped on DC bias component.

(6) Smear after 50 K run; With supplying Magenta Toners I or II which were being applied starting period and gradually consumed, letters image chart having 6% ratio of image area were reproduced on 50000 paper sheets, to evaluate smears in 50000 times rum by following 10 Grades.

Evaluation is made by counting the number of deposited toners on the background areas of the transferring paper sheets, to calculate the number of deposited toners per 1 $cm^2$. Relationships between Grades and toner number deposited (per 1 $cm^2$) were as below.

Grade 10; 0 to 36

Grade 9; 37 to 72

Grade 8; 73 to 108

Grade 7; 109 to 144

Grade 6; 145 to 180

Grade 5; 181 to 216

Grade 4; 217 to 252

Grade 3; 253 to 288

Grade 2; 289 to 324

Grade 1; more than or equal to 325

Example 1

Toner I of 10.1 parts was added to 100 parts of Carrier A, and they were agitated using a ball mill for 20 minutes, to yield 9.2 weight % of developer. Covered ration to the Carrier A by Toner I was 50%, the toner charge per mass of Toner I was −38 $\mu c/g$.

Next, image quality was identified using Imagio Color 4000 by Ricoh Co. Ltd. which was being set to above described conditions, and with above described evaluation manner.

Image density was 1.57, smear degree was Grade 8, small diameter of dots with variance of dot diameter as 0.17 were produced.

Smear tests by 50 K run was then followed using an image chart having 6% ratio of letters image area. After 50000 times rum, smear check revealed an excellent level of Grade 7 hence a high quality of image was obtained.

Comparative Example 1

Toner I of 9.2 parts was added to 100 parts of Carrier B, and they were agitated using a ball mill for 20 minutes, to yield 8.4weight % of developer. Covered ration to the Carrier B by Toner I was 50%, the toner charge per mass of Toner I was −37 $\mu c/g$.

Evaluation of image quality was conducted in similar manner as that of Example 1 using Imagio Color 4000 revealed an identical carrier deposition as Example 1, however variance of dot diameter as 0.24 was larger than that of Example 1. Smear test after 50 K run revealed an increased smear than that of Example 1.

Examples 2 TO 13 Comparative Examples 2 TO 4

Similar evaluations as that described in Example 1, except that combination of Toners and Carriers were varied as shown in Table 2 thereby developers were prepared. Obtained results are shown in Table 2.

TABLE 1-1

| | characteristics of carriers | | | | | | |
|---|---|---|---|---|---|---|---|
| preparation of carriers | (coated) carrier | core material | weight average diameter (μm) | content ratio (wt. %) of particles less than 44 μm diameter | content ratio (wt. %) of particles more than or equal to 62 μm diameter | content ratio (wt. %) of small particles less than 22 μm diameter | magnetic moment of carrier (emu/g, 1KOe) |
| preparation of carrier 1 | carrier A | core (i) | 36.1 | 78.6 | 0.8 | 6.2 | 77 |
| preparation of carrier 2 | carrier B | core (ii) | 39.8 | 60.8 | 0.6 | 6.5 | 77 |
| preparation of carrier 3 | carrier C | core (iii) | 37.4 | 76.1 | 3.3 | 6.1 | 77 |
| preparation of carrier 4 | carrier D | core (iv) | 35.4 | 80.2 | 0.9 | 8.5 | 77 |
| preparation of carrier 5 | carrier E | core (v) | 35.7 | 77.2 | 0.7 | 6.3 | 74 |
| preparation of carrier 6 | carrier F | core (vi) | 35.7 | 80.3 | 0.6 | 2.7 | 77 |
| preparation of carrier 7 | carrier G | core (vii) | 35.9 | 79.7 | 0.7 | 0.6 | 77 |
| preparation of carrier 8 | carrier H | core (viii) | 35.6 | 78.3 | 0.6 | 0.6 | 77 |
| preparation of carrier 9 | carrier I | core (i) | 36.1 | 78.6 | 0.8 | 6.2 | 77 |
| preparation of carrier 10 | carrier J | core (i) | 36.1 | 78.6 | 0.8 | 6.2 | 77 |
| preparation of carrier 11 | carrier K | core (ix) | 35.1 | 80.4 | 0.7 | 6.3 | 83 |
| preparation of carrier 12 | carrier L | core (x) | 36.2 | 82.1 | 0.4 | 6.5 | 81 |
| preparation of carrier 13 | carrier M | core (i) | 36.1 | 78.6 | 0.8 | 6.2 | 77 |
| preparation of carrier 14 | carrier N | core (i) | 36.1 | 78.6 | 0.8 | 6.2 | 77 |
| preparation of carrier 15 | carrier O | core (xi) | 36.1 | 81.5 | 0.7 | 0.6 | 77 |
| preparation of carrier 16 | carrier D' | core (iv) | 36.5 | 88.2 | 0.5 | 0.5 | 77 |

TABLE 1-2

| | characteristics of carriers | | | | | | developer |
|---|---|---|---|---|---|---|---|
| preparation of carriers | bulk density of carrier ($g/m^3$) | carbon amount (%) | electric resistance of carrier (LogR, Ω cm) | content (%) of amino silane coupling agent | composition of core | thickness of coated layer (μm) | the toner charge per mass at 50% covering (μc/g) |
| preparation of carrier 1 | 2.12 | 0 | 15.4 | 0 | MnMgSr ferrite | 0.53 | 38 |
| preparation of carrier 2 | 2.12 | 0 | 15.3 | 0 | MnMgSr ferrite | 0.51 | 37 |
| preparation of carrier 3 | 2.12 | 0 | 15.4 | 0 | MnMgSr ferrite | 0.52 | 38 |
| preparation of carrier 4 | 2.12 | 0 | 15.1 | 0 | MnMgSr ferrite | 0.53 | 40 |
| preparation of carrier 5 | 2.12 | 0 | 15.2 | 0 | MnMgSr ferrite | 0.51 | 39 |
| preparation of carrier 6 | 2.12 | 0 | 15.4 | 0 | MnMgSr ferrite | 0.51 | 37 |
| preparation of carrier 7 | 2.12 | 0 | 15.2 | 0 | MnMgSr ferrite | 0.50 | 39 |
| preparation of carrier 8 | 2.36 | 0 | 15.4 | 0 | MnMgSr ferrite | 0.53 | 38 |
| preparation of carrier 9 | 2.12 | 0 | 15.4 | 3 | MnMgSr ferrite | 0.52 | 41 |
| preparation of carrier 10 | 2.12 | 3 | 12.5 | 5 | MnMgSr ferrite | 0.50 | 37 |

TABLE 1-2-continued

| preparation of carriers | characteristics of carriers: bulk density of carrier ($g/m^3$) | carbon amount (%) | electric resistance of carrier (LogR, Ω cm) | content (%) of amino silane coupling agent | composition of core | thickness of coated layer (μm) | developer: the toner charge per mass at 50% covering (μc/g) |
|---|---|---|---|---|---|---|---|
| preparation of carrier 11 | 2.31 | 0 | 15.2 | 0 | Mn ferrite | 0.51 | 40 |
| preparation of carrier 12 | 2.35 | 0 | 15.1 | 0 | Magnetite | 0.53 | 38 |
| preparation of carrier 13 | 2.12 | 0 | 15.4 | 3 | MnMgSr ferrite | 0.52 | 31 |
| preparation of carrier 14 | 2.12 | 0 | 15.4 | 3 | MnMgSr ferrite | 0.52 | 22 |
| preparation of carrier 15 | 2.12 | 0 | 15.5 | 0 | MnMgSr ferrite | 0.51 | 38 |
| preparation of carrier 16 | 2.12 | 0 | 15.1 | 0 | MnMgSr ferrite | 0.53 | 37 |

TABLE 2-1

| Example | toner | weight average diameter of toner | carrier | the toner charge per mass at 50% covering (μc/g) |
|---|---|---|---|---|
| Ex. 1 | toner I | 7.6 | carrier A | 38 |
| Comp. Ex. 1 | toner I | 7.6 | carrier B | 37 |
| Comp. Ex. 2 | toner I | 7.6 | carrier C | 38 |
| Comp. Ex. 3 | toner I | 7.6 | carrier D | 40 |
| Comp. Ex. 4 | toner I | 7.6 | carrier E | 39 |
| Ex. 2 | toner I | 7.6 | carrier F | 37 |
| Ex. 3 | toner I | 7.6 | carrier G | 39 |
| Ex. 4 | toner I | 7.6 | carrier H | 38 |
| Ex. 5 | toner I | 7.6 | carrier I | 41 |

TABLE 2-1-continued

| Example | toner | weight average diameter of toner | carrier | the toner charge per mass at 50% covering (μc/g) |
|---|---|---|---|---|
| Ex. 6 | toner I | 7.6 | carrier J | 37 |
| Ex. 7 | toner I | 7.6 | carrier K | 40 |
| Ex. 8 | toner I | 7.6 | carrier L | 38 |
| Ex. 9 | toner I | 7.6 | carrier M | 31 |
| Ex. 10 | toner I | 7.6 | carrier N | 22 |
| Ex. 11 | toner II | 5.8 | carrier N | 29 |
| Ex. 12 | toner I | 7.6 | carrier O | 38 |
| Ex. 13 | toner I | 7.6 | carrier D' | 37 |

TABLE 2-2

| Example | evaluation result of qualities: average dot diameter (μm) | variance of dot diameter | uniformity of halftone area (grade) | optical density of image | smear in background area (grade) | carrier deposition: electric potential in background area V (*) | smear in background area after 50 K run (grade) |
|---|---|---|---|---|---|---|---|
| Ex. 1 | 51 | 0.17 | 9 | 1.57 | 8 | 250 | 7 |
| Comp. Ex.1 | 53 | 0.24 | 8 | 1.58 | 7 | 250 | 6 |
| Comp. Ex. 2 | 53 | 0.23 | 8 | 1.59 | 7 | 250 | 6 |
| Comp. Ex. 3 | 54 | 0.19 | 7 | 1.61 | 7 | 100 | 5 |
| Comp. Ex. 4 | 51 | 0.20 | 9 | 1.58 | 7 | 100 | 5 |
| Ex. 2 | 49 | 0.15 | 8 | 1.61 | 9 | 300 | 8 |
| Ex. 3 | 50 | 0.11 | 9 | 1.62 | 9 | 350 | 8 |
| Ex. 4 | 51 | 0.12 | 9 | 1.60 | 9 | 400 | 8 |
| Ex. 5 | 49 | 0.16 | 9 | 1.57 | 10 | 300 | 9 |
| Ex. 6 | 54 | 0.19 | 10 | 1.86 | 10 | 250 | 8 |
| Ex. 7 | 52 | 0.18 | 9 | 1.61 | 9 | 400 | 8 |
| Ex. 8 | 53 | 0.17 | 9 | 1.63 | 9 | 400 | 8 |
| Ex. 9 | 54 | 0.16 | 9 | 1.78 | 10 | 300 | 9 |
| Ex. 10 | 55 | 0.16 | 9 | 1.93 | 10 | 300 | 9 |
| Ex. 11 | 50 | 0.13 | 9 | 1.74 | 9 | 250 | 7 |
| Ex. 12 | 49 | 0.12 | 9 | 1.65 | 9 | 350 | 8 |
| Ex. 13 | 52 | 0.11 | 9 | 1.64 | 9 | 350 | 8 |

(*) Background potential for initiating carrier deposition = DC bias potential (VD) - charged potential (Vd).

The present invention can provide an excellent carrier and a developer giving high optical density of image with no smearing of background area, and showing good reproducibility in developing of small dots in image. Further, the carrier of the present invention has an excellent character that it is hard to result a so-called carrier deposition. Moreover, the present invention provides high quality and high reliability by combination of the carrier having specified electric and magnetic characteristics, and toner having a defined small diameter.

What is claimed is:

1. A carrier for electrophotographic developer comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles.

2. A carrier for electrophotographic developer as claimed in claim 1, wherein said carrier component particles having a diameter of less than 22 micrometer is in an amount of 3.0 wt. % or less.

3. A carrier for electrophotographic developer as claimed in claim 1, wherein said carrier component particles having diameter of less than 22 micrometer is in an amount of 1.0 wt. % or less.

4. A carrier for electrophotographic developer as claimed in claim 1, wherein the bulk density of the carrier is in degree of 2.2 g/cm$^3$ or more.

5. A carrier for electrophotographic developer as claimed in claim 1, wherein the specific electric-resistance denoted by (log R·cm) of the carrier is in a value of 12.0 or more.

6. A carrier for electrophotographic developer as claimed in claim 1, wherein the magnetic core particle is a MnMgSr ferrite material.

7. A carrier for electrophotographic developer as claimed in claim 1, wherein the magnetic core particle is a Mn ferrite material.

8. A carrier for electrophotographic developer as claimed in claim 1, wherein the magnetic core particle is a magnetite material.

9. A carrier for electrophotographic developer as claimed in claim 1, wherein the resinous coating layer is a silicone resin coating layer.

10. A carrier for electrophotographic developer as claimed in claim 1, wherein the resin layer comprises a resin layer containing a reactionproduct by amino silane type of coupling agents.

11. An electrophotographic developer using a toner and a carrier comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt % or less, based on the total amount of said carrier particles.

12. An electrophotographic developer using a toner and a carrier as claimed in claim 11, wherein the toner charge per mass is less than or equal to 35 $\mu$c/g at coverage ratio 50% on the surface of the carrier by the toner.

13. An electrophotographic developer using a toner and a carrier as claimed in claim 11, wherein the toner charge per mass at 50% is less than or equal to 25 $\mu$c/g at coverage ratio 50% on the surface of the carrier by the toner.

14. An electrophotographic developer using a toner and a carrier as claimed in claim 11, wherein the toner has a weight-average particle-diameter of less than or equal to 6.0 $\mu$m.

15. A container for electrophotographic developer using a toner and a apparatus loaded with a carrier comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising;

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles.

16. An image for apparatus loaded with a container for electrophotographic developer, wherein the developer uses a toner and a carrier comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles.

17. An image forming method using an electrophotographic developer, wherein the developer uses a toner and a carrier comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles.

18. A preparation method of a earlier for electrophotographic developer comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles;

and comprising steps of (i) classifying a magnetic material of finely pulverized particles, thereby obtaining a core material of particles having a weight-average particle-diameter(Dw) of the carrier ranges from 25 to 45 $\mu$m, the content of particles having diameter less than 44 $\mu$m is more than or equal to 75% by weight, the content of particles having diameter more than or equal to 62 $\mu$m is less than one percent by weight, the content of particles having diameter less than 22 $\mu$m is less than or equal to 7.0% by weight, the magnetic moment of the carrier at 1 kilo Oe of magnetic field is more than or equal to 76 emu/g, (ii) providing a resinous film onto the magnetic core material.

19. A preparation method of the carrier as claimed in claim 18, wherein a vibration sieve equipped with an ultrasonic wave-generator is used in the step of (i) classifying a magnetic material of finely pulverized particles.

20. A preparation method of a carrier for electrophotographic developer comprising carrier particles, each carrier particle comprising a magnetic core particle and a resin layer formed on the surface of said magnetic core particle, and said carrier having a magnetic moment of 76 emu/g or more at 1 KOe, and said carrier particles having a weight-average particle diameter (Dw) in a range of 25 to 45 micrometer, and said carrier particles comprising:

(1) carrier component particles having a diameter of less than 44 micrometer in an amount of 75 wt. % or more, (2) carrier component particles having a diameter of 62 micrometer or more in an amount of less than 1 wt. %, and (3) carrier component particles having a diameter of less than 22 micrometer in an amount of 7.0 wt. % or less, based on the total amount of said carrier particles;

and comprising steps of (i) providing a resinous film onto a magnetic core material of finely pulverized particles, (ii) classifying the magnetic core material of finely pulverized particles having resinous film thereon, thereby obtaining a core material of particles having a weight-average particle-diameter(Dw) of the carrier ranges from 25 to 45 $\mu$m, the content of particles having diameter less than 44 $\mu$m is more than or equal to 75% by weight, the content of particles having diameter more than or equal to 62 $\mu$m is less than one percent by weight, the content of particles having diameter less than 22 $\mu$m is less than or equal to 7.0% by weight, the magnetic moment of the carrier at 1 kilo Oe is more than or equal to 76 emu/g.

21. A preparation method of the carrier as claimed in claim 20, wherein a vibration sieve equipped with an ultrasonic wave-generator is used in the step of (ii) classifying the magnetic core material of finely pulverized particles having a resinous film thereon.

22. A preparation method of the carrier as claimed in claim 19 or 21, wherein a vibration sieve, which is quipped with an ultrasonic wave-generator and a resonator ring to transfer ultrasonic waves generated by the ultrasonic wave-generator to the vibration sieve, is used in the step of classifying a magnetic material of finely pulverized particles.

* * * * *